US008410724B2

(12) United States Patent
Adenau

(10) Patent No.: US 8,410,724 B2
(45) Date of Patent: Apr. 2, 2013

(54) LIGHTING CONTROL CONSOLE FOR CONTROLLING A LIGHTING SYSTEM

(75) Inventor: Michael Adenau, Würzburg (DE)

(73) Assignee: MA Lighting Technology GmbH (DE)

( * ) Notice: Subject to any disclaimer, the term of this patent is extended or adjusted under 35 U.S.C. 154(b) by 1045 days.

(21) Appl. No.: 12/409,197

(22) Filed: Mar. 23, 2009

(65) Prior Publication Data

US 2010/0238200 A1 Sep. 23, 2010

(51) Int. Cl.
*H05B 39/00* (2006.01)
*F21V 33/00* (2006.01)

(52) U.S. Cl. ..... 315/312; 315/318; 345/184; 362/82; 362/233

(58) Field of Classification Search ..... 315/130, 315/131, 312–321; 362/85, 227, 232–240, 362/249.01, 249.07, 249.11, 249.13, 257; 345/156, 157, 170, 184
See application file for complete search history.

(56) References Cited

U.S. PATENT DOCUMENTS 4,392,187 A * 7/1983 Bornhorst ..... 362/233
5,209,560 A * 5/1993 Taylor et al. ..... 362/85
6,331,813 B1 * 12/2001 Belliveau ..... 340/12.32

* cited by examiner

*Primary Examiner* — Jimmy Vu
(74) *Attorney, Agent, or Firm* — Schwegman Lundberg & Woessner, P.A.

(57) ABSTRACT

Various embodiments of the invention relate to a lighting control console for controlling a lighting system comprising wherein digital adjusting commands, which can be transferred to the lighting devices of the lighting system via data connections, are generated in the lighting control console, and wherein the lighting control console comprises at least one housing, in which the hardware components are arranged so as to be protected from external influences, and wherein the lighting control console comprises a plurality of operating elements, in particular pushbuttons, slide controls and/or rotary controls, which are arranged at the upper side of the housing and by means of which operating commands can be input, and wherein the lighting control console comprises at least one display device, at which a user interface can be displayed.

7 Claims, 7 Drawing Sheets

LIGHTING CONTROL CONSOLE FOR CONTROLLING A LIGHTING SYSTEM

The invention relates to a lighting control console for controlling a lighting system.

BACKGROUND

Generic lighting control consoles are used for controlling lighting systems such as are used for example in theaters and/or on concert stages. These lighting systems normally include a large number of lighting devices, such as stage spotlights, and in their turn the lighting devices themselves can be switched between a wide variety of lighting states, for example different colors. The various lighting devices with their different lighting states are controlled by programmed parameters in the lighting software of the lighting control console.

SUMMARY

Conventional lighting systems in this context may include as many as several thousand lighting devices. The lighting control consoles provided to control the lighting devices have a housing which accommodates the electronic hardware essential for carrying out its function and protects it from external influences. A microcontroller, for example a complex digital processor that allows for digital data and signal processing, is usually located in the housing to control these complex lighting systems. Operating elements such as pushbuttons, slide controls and/or rotary controls are also provided on the housing to enable the operator to enter commands. The lighting control consoles are usually equipped with a display device as well, for example a color monitor, so that a user interface can be displayed.

The operating commands are entered via the operating elements by the operator in order to program the lighting software or to control the lighting software during a concert or a theatrical performance. These operating commands may for example consist of selecting a certain lighting device or adjusting a certain lighting parameter. The operating commands assigned to the individual operating elements on the lighting control console may be altered by switching the menus concerned so that correspondingly complex lighting programs may be configured and controlled.

Lighting control consoles with an extremely variable scope of functions and performance are known from the related art. For example, there are small lighting control consoles with a relatively simple design, which may be used to control the lighting systems on smaller stages. These small lighting control consoles are only equipped with a relatively small number of operating elements and often with only one display device. At the other end of the scale, lighting control consoles for controlling extremely complex lighting systems, such as are used for television presentations, are also known. These large lighting control consoles are equipped accordingly with several display devices and a very large number of operating elements, such as pushbuttons, slide controls and/or rotary controls. Even the scope of performance and function of the hardware, which is otherwise still present in the lighting control console, is usually altered to match the performance and function capabilities listed in the specification for the control console.

In known lighting control consoles, specific hardware is selected depending on the size, that is to say the desired scope of performance and function, and the lighting control console is built up on the basis of this hardware. The disadvantage of this hardware topology being dependent on the scope of performance and function is that the lighting control consoles of each different performance and function class are configured entirely differently. A flexible adaptation of the scope of performance and function is not possible.

Based on this state of the art, it is thus the object of the present invention to propose a new lighting control console for controlling lighting systems, which is capable of being adapted to the respective required scope of performance and function in a flexible manner and which, at the same time, provides for a high operating comfort.

This object is achieved by means of a lighting control console according to the teaching of claim 1.

Advantageous embodiments of the invention are the object of the subordinate claims.

The lighting control console according to the invention is initially based on the fundamental idea that external input modules and external display modules are connected to the lighting control console, wherein the input modules and the display modules in each case encompass their own module housing and are thus independent of the actual lighting control console. By means of this possibility of combining external input modules and external display modules, it becomes possible to adapt the scope of performance and function of the lighting control console, which is available in each case, in a flexible manner. If only a relatively small scope of function is required, the lighting control console can be used individually without external input modules. The external input modules and external display modules can then be connected to the lighting control console according to the invention in response to a respective increase in the scope of performance and function.

The operating elements and display devices, which are fixedly installed into the lighting control console, have a predetermined allocation as to which operating commands are displayed for the user at which display device as a function of the respectively used operating element. This fixed allocation of the individual operating elements to certain display devices is not possible in view of the external input modules and external display modules, because it is not determined from the first in view of the flexible combination possibilities, which number of external input modules and which number of external display modules is actually connected to the lighting control console. Provision is made in a storage element of the lighting control console according to the invention for a configuration file for the purpose of affording the user with the opportunity, in response to a connection of at least two external input modules and at least two external display modules to the lighting control console, to be capable of adapting the resulting operator interface, which results from ail of the operating elements of the lighting control console and the input modules and from all of the display surfaces at the lighting control console and at the display modules, in a flexible manner and according to its own requirements. The allocation of at least individual operating elements of the input modules to certain display modules can be stored in this configuration file. The operating commands, which are input at an operating element of an input module, are displayed at the respectively allocated display module as a function of the respective data in the configuration file and the resulting allocation. As a result, the user thus has the opportunity to allocate individual operating elements of the input modules to certain display modules by adapting the data in the configuration file so that a flexible adaptation of the operator interface is made possible with regard to the externally connected display modules.

An allocation of individual operating elements of the external input modules to certain display modules takes place in the basic design of the invention. In individual cases, however, this type of configuration can be extraordinarily complex because, in many cases, the input modules encompass a plurality of operating elements, which, if applicable, would then have to be individually allocated to the different display modules. So as to simplify the configuration of the configuration file, it is thus particularly advantageous when it is at least optionally also possible to carry out an allocation of complete input modules to certain display modules. In other words, this means that all of the operating elements of an input module are allocated to a certain display module so that all of the operating commands, which are input at these operating elements of an input module, are displayed at a certain display module.

One aspect of the lighting control console according to the invention is based on the fact that external display modules, which can be positioned independently of the housing of the lighting control console, are connected to the lighting control console. The display modules can be conventional computer monitors with their own housing, for example. The fact that these external display modules can thus be positioned independently of the housing of the lighting control console results in a completely different user interface, depending on the selected positioning of the individual display modules, because this user interface eventually results from the combination of the displays at the different display modules. So as to be capable of adapting to the user the again flexible adaptation of the resulting overall user interface in a flexible manner, it is thus particularly advantageous when position data for describing the position of the different display modules can be stored in the configuration file as well. In this context, these position data can eventually be any data which describe a certain location relationship between the individual display modules relative to one another and/or between the individual display modules and the lighting control console. In case of a mobile use of the lighting control consoles, the user then has the option to set up the lighting control console and the external display modules as a function of the respective conditions which are available on-site. Subsequently, the user interface displayed at the display modules can then be adapted in a variable manner by means of adapting the configuration file.

It is generally arbitrary how the position of the individual display modules is described by means of the position data in the configuration file. A particularly advantageous possibility is for the display surfaces of the individual display modules to be arranged in each case in a common display plane, wherein the position data in the configuration file then describe exactly the position of the display surfaces of the individual display modules in the display plane. In particular proximity relationships between the display surfaces of the different display modules can be described by means of such a configuration of the position data so that it can be specified in the configuration file offhand, for example, which display modules are arranged next to one another and which display modules are arranged on top of one another.

The position data of the individual display modules can be stored in a particularly simple manner in the configuration file in the form of X-Y coordinates. This means, in other words, that the position data then specify the location of the individual display surfaces in the X direction and in the Y direction, respectively. The location designation in the X direction and in the Y direction, respectively, can thereby absolutely also take place in a non-numerical manner, for example by specifying the uppermost and lowermost display surface, respectively, or by specifying the leftmost and rightmost display surface, respectively. The display surfaces respectively provided therebetween can be numbered consecutively accordingly.

The storage of the positioning of the individual display surfaces at the display modules is particularly advantageous when inputs are made at the lighting control console by means of using a cursor control device, for example a computer mouse or a trackball. That is to say, when the different display surfaces of the connected display modules form a common virtual operator interface across which the cursor, which is controlled by the cursor control device, must be moved, it is of the utmost importance for a comfortable use that a positionally accurate cross-fading of the cursor is carried out between the individual display surfaces. In oilier words, this means that the cursor, upon reaching the right-hand margin of a display surface, for example, must be hidden at this display surface, and that it must subsequently be shown at the left-hand margin of the display surface adjacent to the right. This positionally accurate showing of the cursor, which is controlled by the cursor control device, can be attained easily in that the position data are queried in the configuration file.

In many cases, external computer, for example media servers, are connected to the lighting control console as well so as to realize further functionalities. These external computers are then typically equipped with their own display module, for the purpose of which a further computer screen can be connected to the computer, for example. So as to be capable of integrating this display surface of the display module, which is connected to the external computer, into the total operator interface as well, so that the cursor, which is controlled by the cursor control device can be moved across the entire operator interface, it is particularly advantageous when the position of the display module, which is connected to the external computer, is stored in the configuration file as well.

BRIEF DESCRIPTION OF THE DRAWINGS

Different embodiments of the invention are schematically illustrated in the drawings and will be defined below in an exemplary manner.

DETAILED DESCRIPTION

Figure 1:
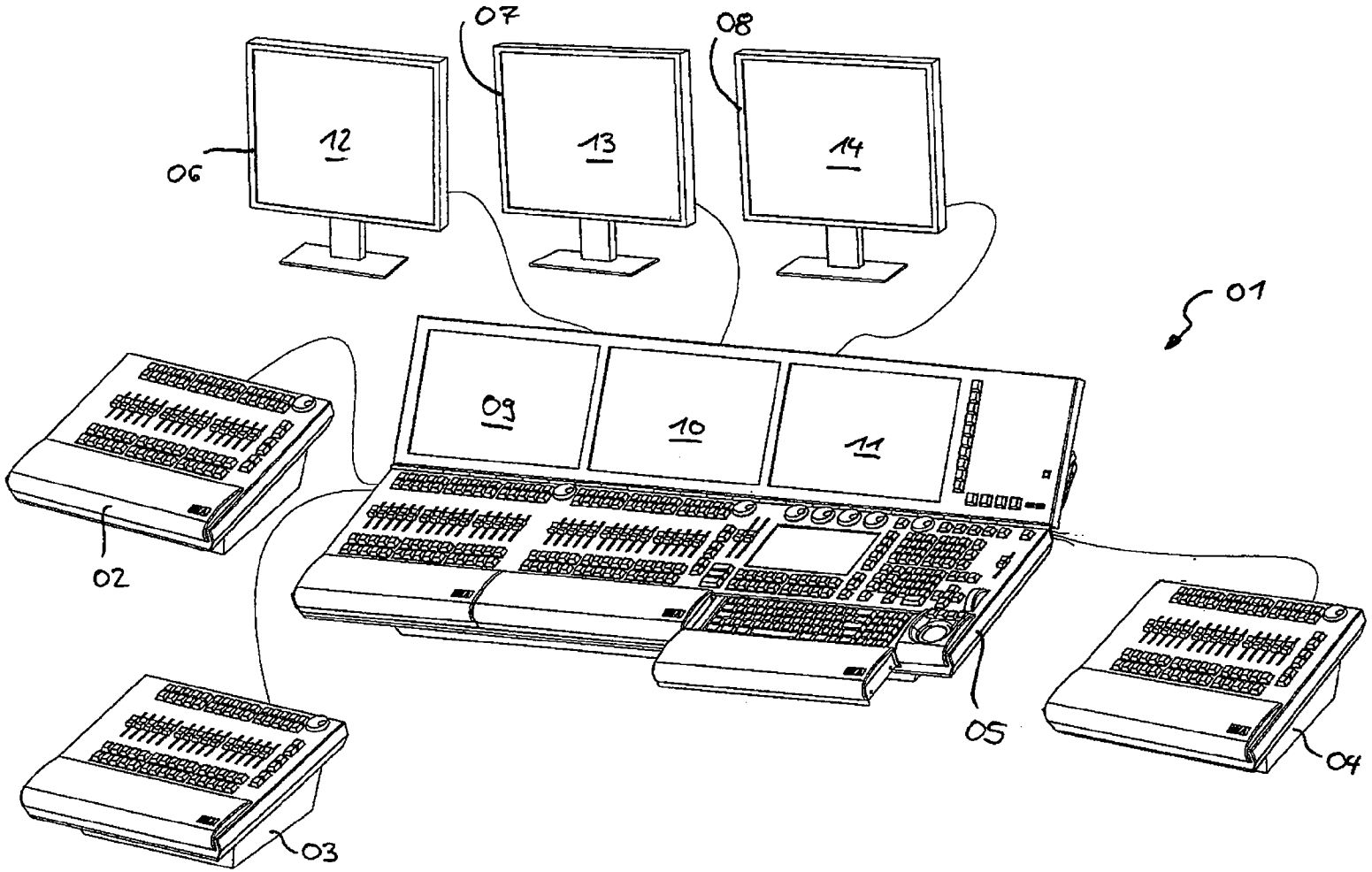
FIG. 1 shows a lighting control console according to a first configuration comprising three external display modules and three external input modules in a perspective view.

FIG. 1 shows a lighting control console 01, which is installed in a housing 05 and to which three external input modules 02, 03 and 04 as well as three external display modules 06, 07 and 08 are connected. The total available operator interface thus results from the input elements, that is, pushbuttons, slide controls and rotary controls, at the housing of the lighting control console 01, the display surfaces 09, 10 and 11 in the housing of the lighting control console 01, the input elements in the housings of the external input modules 02, 03 and 04 and the display surfaces 12, 13 and 14 at the external display modules 06, 07 and 08.

So as to increase the operating comfort for the user, a storage element comprising a configuration file, which is stored therein, is available in the lighting control console 01. The allocation of the external input modules 02, 03 and 04 to the external display modules 06, 07 and 08 is stored in this configuration file. In the illustrated embodiment, the external input module 02 is thereby allocated to the external display module 06, the external input module 03 is allocated to the external display module 07 and the external input module 04 is allocated to the external display module 08. This means that ail of the operating commands input at the input elements of the external input module 02 are displayed at the image surface 12 of the external display module 06. The operating commands, which are input at the input elements of the input module 03 are accordingly displayed at the display surface 13 of the display module 07 and the operating commands, which are input at the input elements of the input module 04 are displayed at the display surface 14 of the display module 08. By changing the configuration file, the user can thereby change the allocation between the individual input modules 02 to 04 to the display modules 06 to 08.

Figure 2:
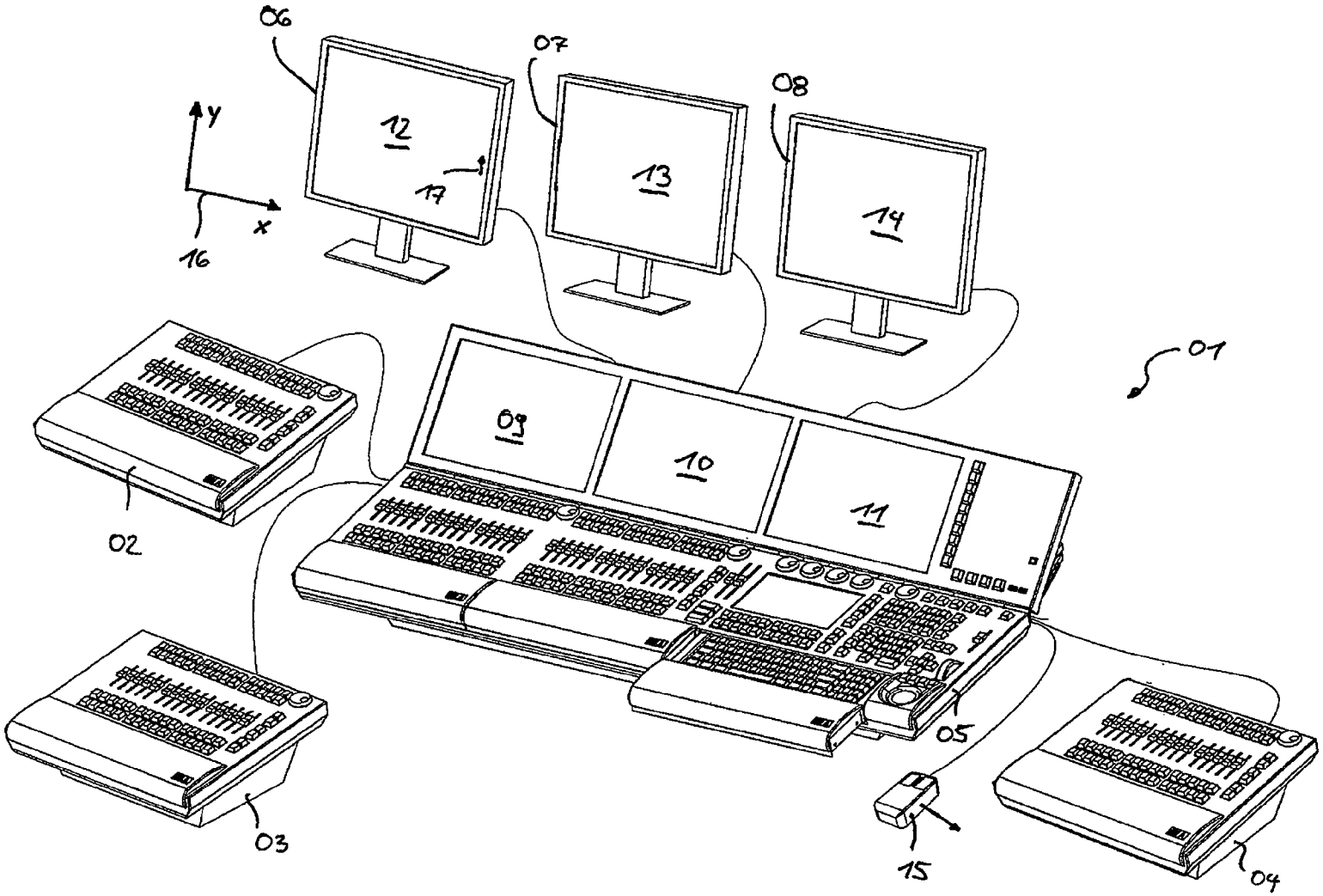
FIG. 2 shows the lighting control console according to FIG. 1 comprising a computer mouse connected thereto when a cursor is displayed at a first display module.
Figure 3:
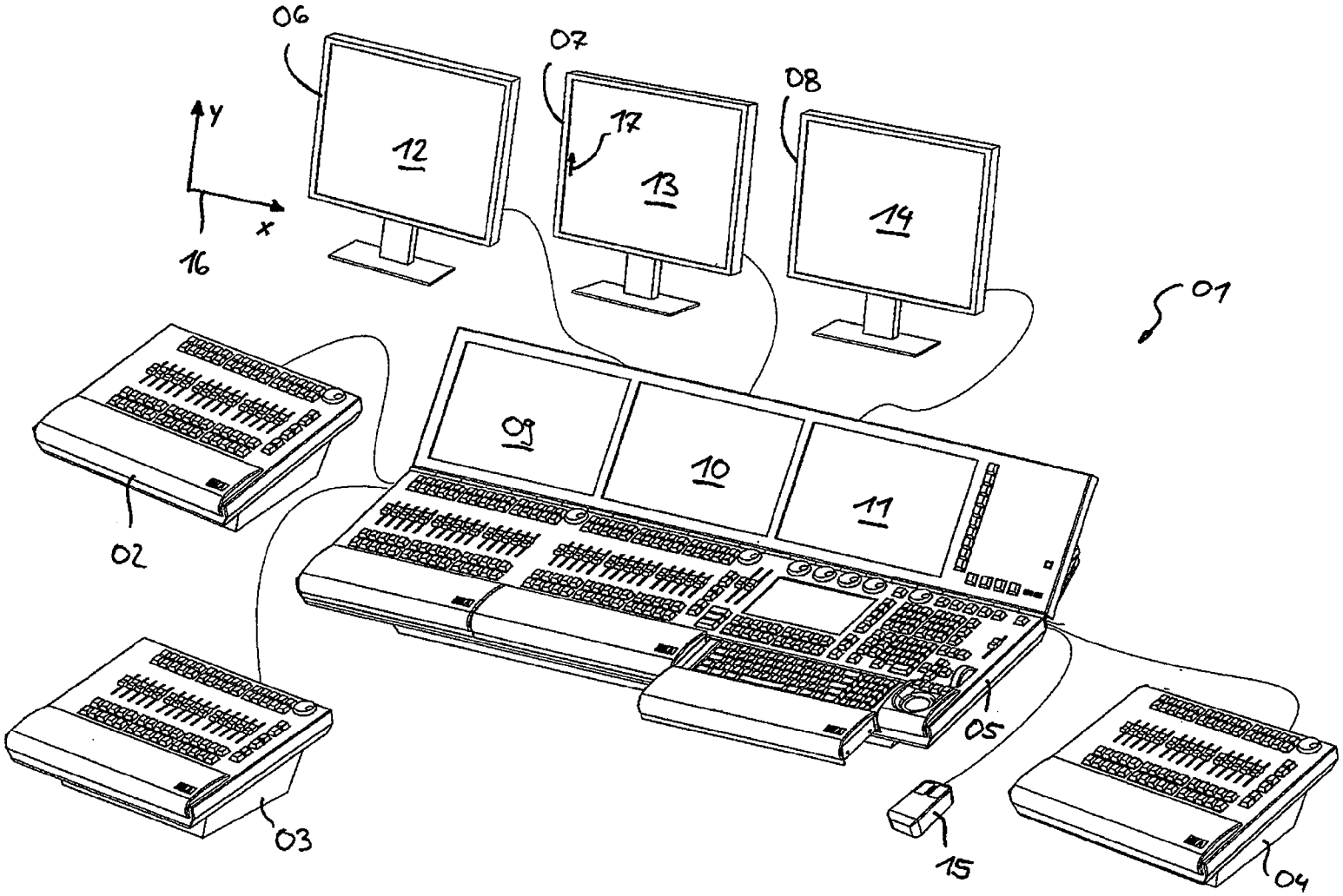
FIG. 3 shows the lighting control console according to FIG. 2 after moving the computer mouse.

FIG. 2 shows the lighting control console 02 with the input modules 02 to 04 and with the display modules 06 to 08 in the case of an additional connection of a computer mouse 15 to the lighting control console 01. The position of the display surfaces 12, 13 and 14 is thereby additionally stored in the configuration file in an X-Y coordinate system 16 as well. By means of evaluating the configuration file, it is thus possible to move the cursor 17, which is to be displayed at the display surface 12, 13 and 14 and which is controlled by moving the computer mouse 15, in a positionally accurate manner between the different display surfaces 12, 13 and 14. When the cursor 17 is moved to the right-hand margin of the display surface 12, for example, as is shown in FIG. 2 in an exemplary manner, and when the computer mouse is additionally shifted to the right, the cursor 17 is hidden at the display surface 12 and is shown at the left-hand margin of the display surface 13.

Figure 4:
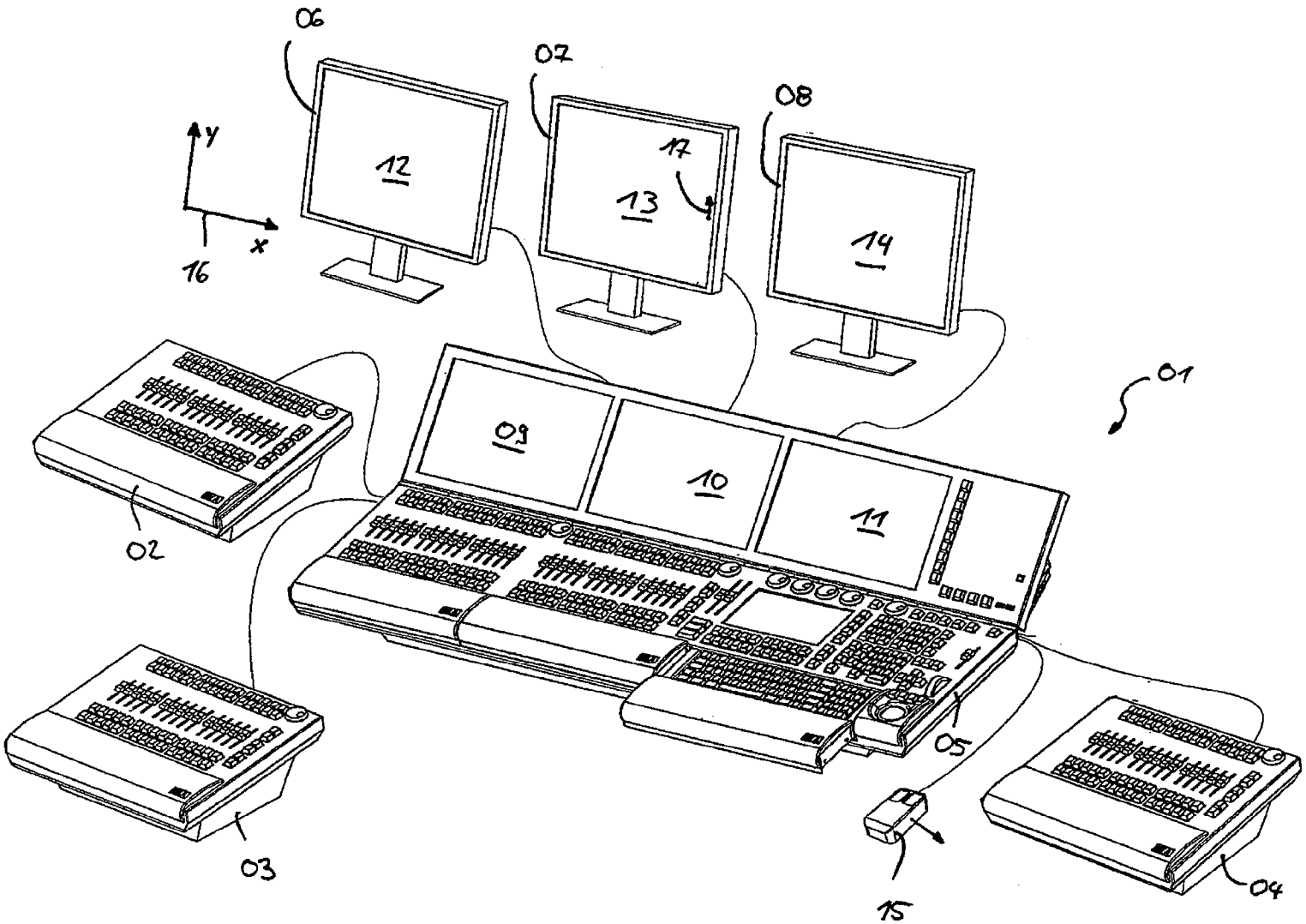
FIG. 4 shows the lighting control console according to FIG. 2 when the cursor is displayed at a second display module.
Figure 5:
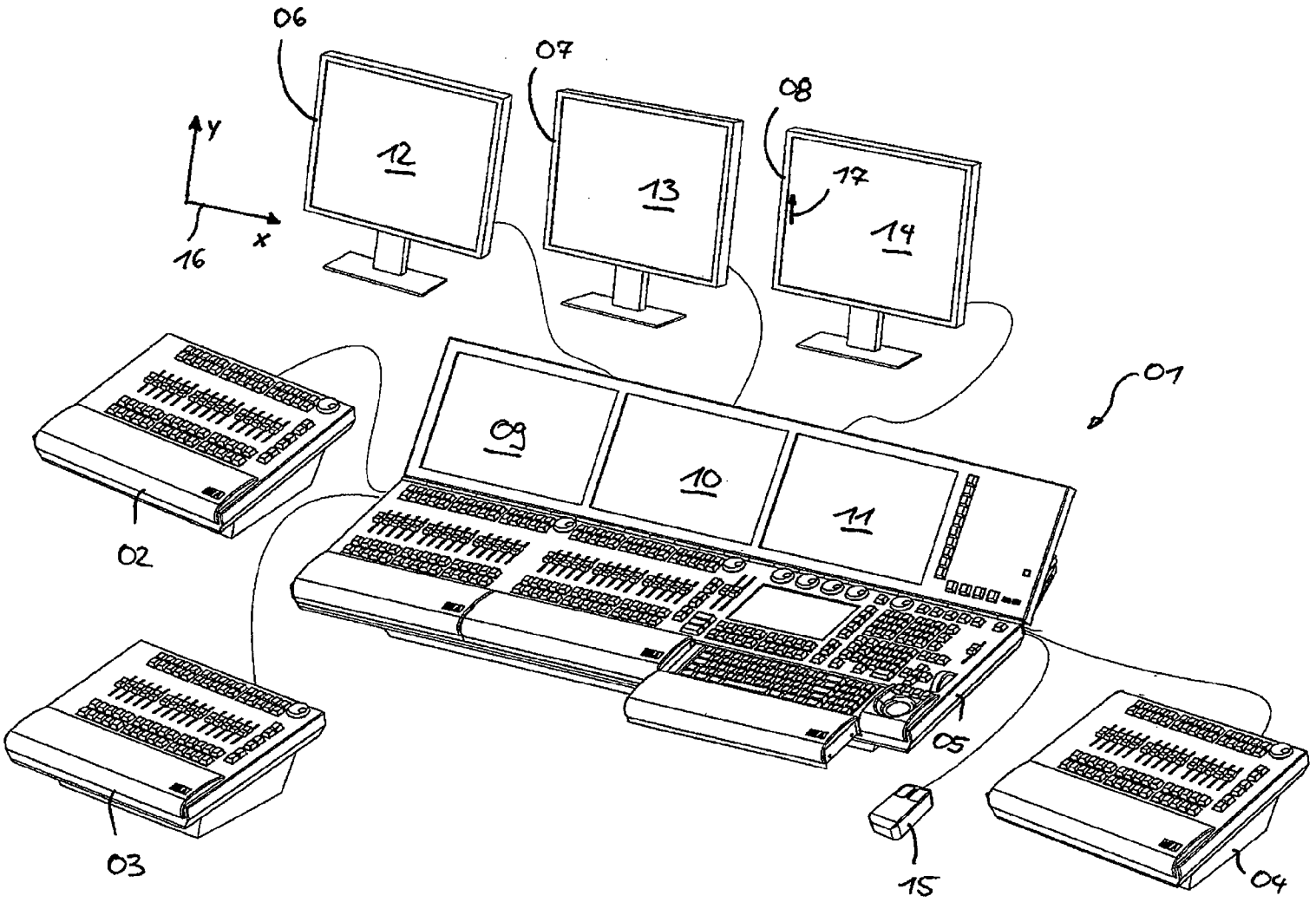
FIG. 5 shows the lighting control console according to FIG. 4 after moving the computer mouse.

FIG. 4 shows the cursor 17 upon reaching the right-hand margin of the display surface 13 at the display module 07. When the computer mouse 15 is again moved further to the right, the configuration file is evaluated in the lighting control console 01 and the cursor 17 is shown at the left-hand margin of the display surface 14 as a function of the position data of the display modules 06, 07 and 08, which are stored therein, as is illustrated in an exemplary manner in FIG. 5.

Figure 6:
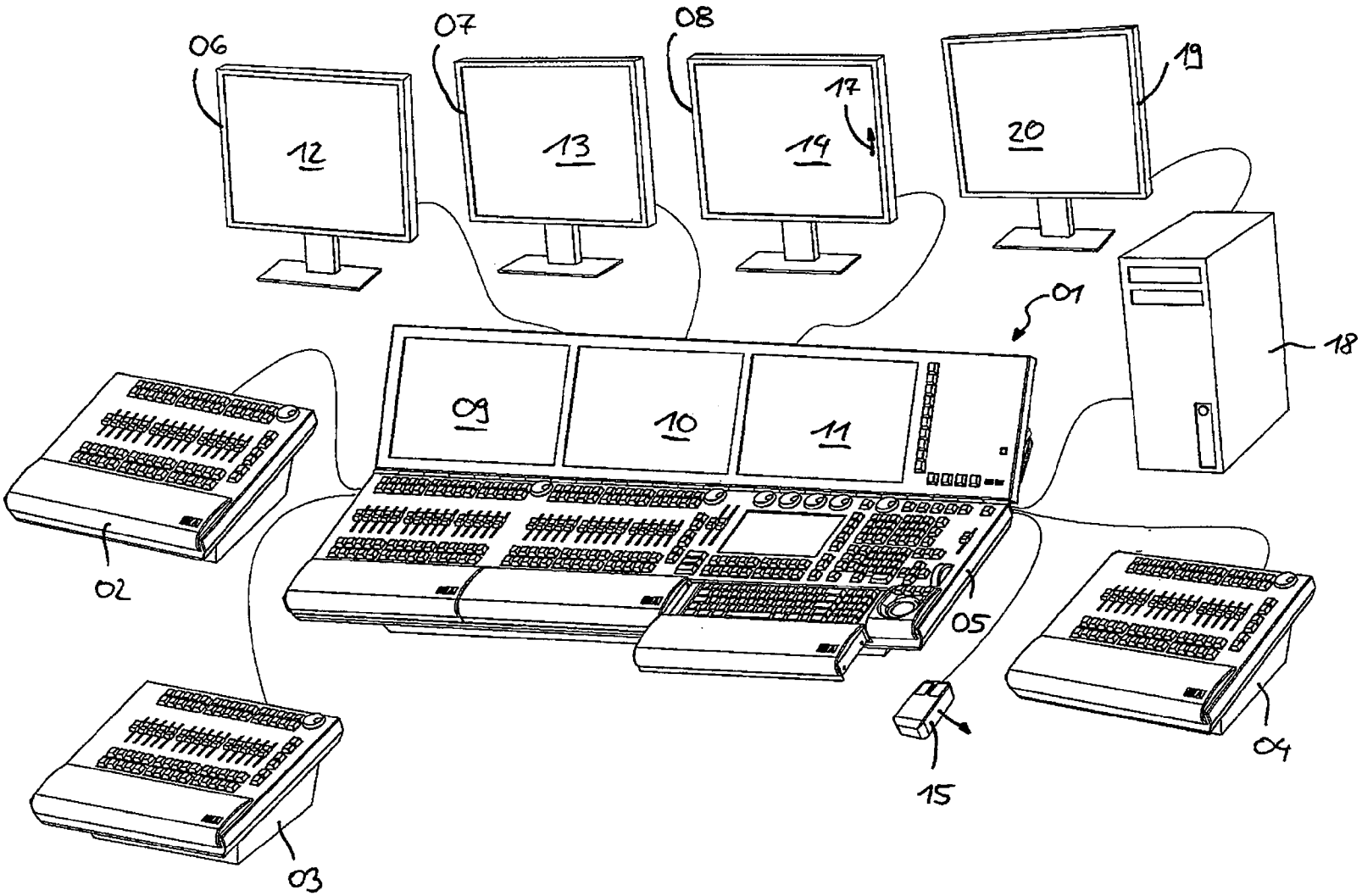
FIG. 6 shows the lighting control console according to FIG. 2 when an external computer comprising a display module connected thereto is additionally connected when a cursor is displayed at a third display module.
Figure 7:
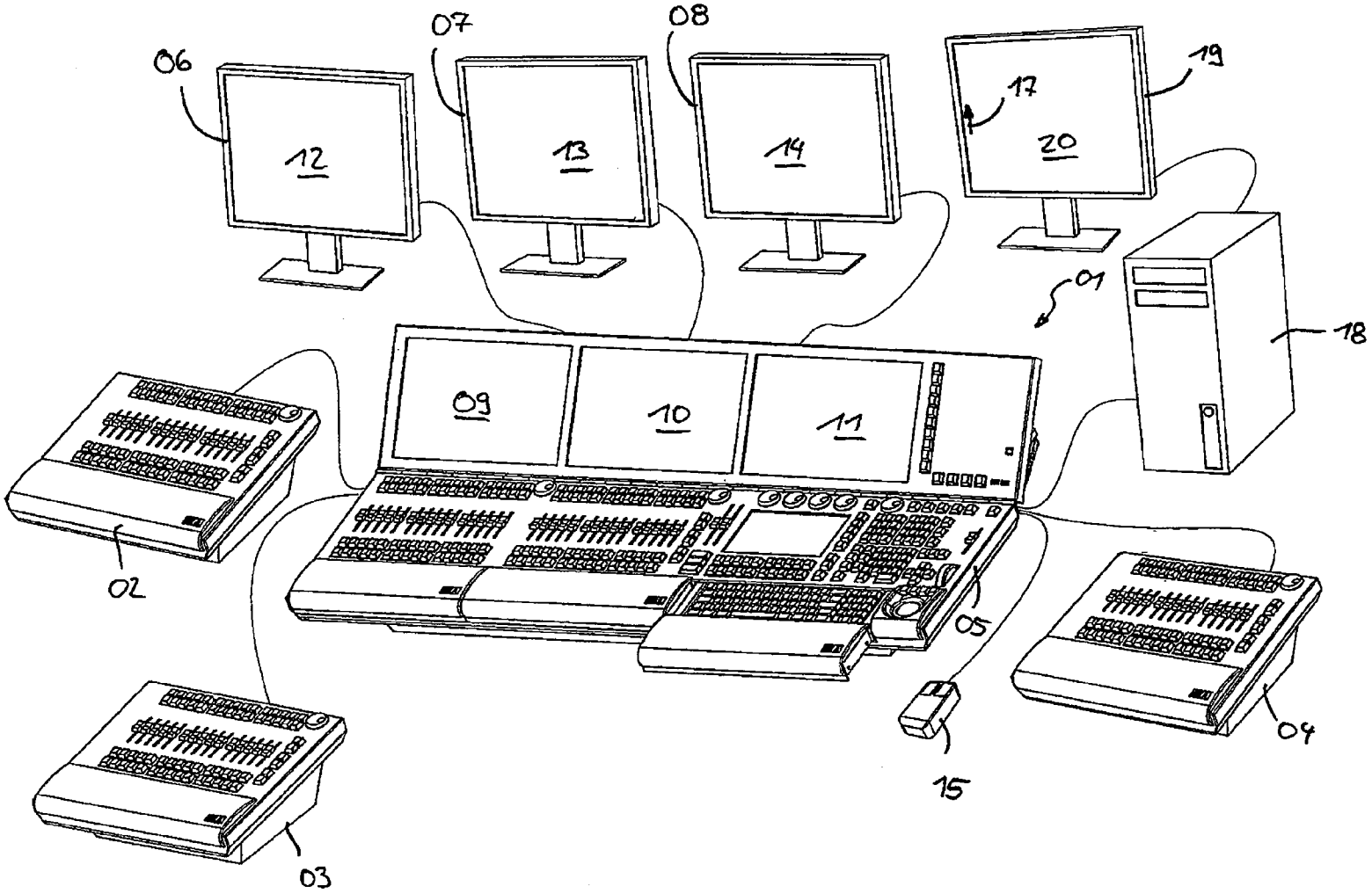
FIG. 7 shows the lighting control console according to FIG. 6 after the computer mouse is moved.

FIG. 6 shows the lighting control console 01 comprising the input modules 02 to 04 and the display modules 06 to 08 in the case of an additional connection of an external computer 18, for example a media server, to the lighting control console 01. A display module 19, the display surface 20 of which is a component of the common operator interface of the lighting control console 01, is thereby in turn connected to the computer 18. This means in other words that the position data of the display module 19 are also stored in the configuration file of the lighting control console 01. When the cursor 17 is now moved to the right-hand margin of the display surface 14 at the display module 08 and when the computer mouse 15 is moved even further to the right, the cursor 15 is subsequently shown at the display surface 20 of the display module 19 by means of evaluating the position data in the configuration file, as is illustrated in FIG. 7.

What is claimed is:

1. An apparatus comprising:

a lighting control console for controlling a lighting system, wherein digital adjusting commands, which are being transferred to the lighting devices of the lighting system via data connections, are generated by the lighting control console, wherein the lighting control console comprises at least one housing in which hardware components are arranged so as to be protected from external influences, wherein the lighting control console further comprises a plurality of operating elements, particularly pushbuttons, slide controls and/or rotary controls, which are arranged on an upper side of the housing and are operable for inputting operating commands, and wherein the lighting control console further comprises at least one display device on which an user interface is being displayed, and at least two external input modules and at least two external display modules are connected to the lighting control console, wherein each of the input modules and the display modules encompass their encompasses module housings, which are being positioned independently of the housing of the lighting control console, wherein each input module comprises other operating elements, particularly pushbuttons, slide controls and/or rotary controls, which are arranged on an upper side of the module housing, wherein a configuration file in which an allocation of at least individual operating element of the input modules to certain display modules is being stored, is stored in an electronic storage element of the lighting control console, and wherein operating commands, which are input at an operating element of the input module, are displayed at the display module, which is respectively allocated according to the configuration file.

2. The apparatus according to claim 1, wherein an allocation of complete input modules to certain display modules is being stored in the configuration file, and wherein all of the operating commands, which are input at different operating elements of the input module, are displayed at the display module, which is respectively allocated according to the configuration file.

3. The apparatus according to claim 1, wherein position data for describing a position of different display modules is being stored in the configuration file.

4. The apparatus according to claim 3, wherein plane display surfaces of an individual display module are arranged in a common display plane, wherein a position of the display surfaces of the individual display module in the display plane is described by means of the position data in the configuration file.

5. The apparatus according to claim 4, wherein an order of the display surfaces of the individual display module in an X direction in the display plane and/or the order of the display surfaces of the individual display module in an Y direction in the display plane is described by means of the position data in the configuration file.

6. The apparatus according to claim 1, wherein provision is made at the lighting control console with a control device, particularly a computer mouse or a track ball, by means of the movement of which the control device is possible to control the position of a cursor, which is to be displayed selectively at the different display modules, wherein the configuration file is queried during a computation of the position of the cursor, which is to be displayed at the display modules for the purpose of being capable of computing the location of the cursor with a transition from the display surface of the display module to a display surface of an adjacent display module.

7. The apparatus according to claim 6, wherein an external computer, particularly a media server, is connected to the lighting control console, a data of said external computer being capable of being displayed at another display module, which is connected to said external computer, wherein the configuration file is queried during the computation of the position of the cursor, which is to be displayed at the display modules.

* * * * *